US006798357B1

(12) United States Patent
Khan

(10) Patent No.: US 6,798,357 B1
(45) Date of Patent: Sep. 28, 2004

(54) METHOD AND SYSTEM FOR COLLECTING TRAFFIC INFORMATION

(75) Inventor: M. Salahuddin Khan, Lake Forest, IL (US)

(73) Assignee: Navteq North America, LLC., Chicago, IL (US)

( * ) Notice: Subject to any disclaimer, the term of this patent is extended or adjusted under 35 U.S.C. 154(b) by 43 days.

(21) Appl. No.: 10/247,399

(22) Filed: Sep. 19, 2002

(51) Int. Cl.[7] ..... G08G 1/123
(52) U.S. Cl. ..... 340/989; 701/117
(58) Field of Search ..... 340/989, 936, 340/990, 995.1, 995.13; 342/104, 105, 107, 454, 461; 701/117, 118, 119

(56) References Cited

U.S. PATENT DOCUMENTS 5,396,429 A 3/1995 Hanchett
5,528,234 A 6/1996 Mani et al.
5,815,802 A * 9/1998 Loechner, II ..... 455/414.1
6,278,939 B1 * 8/2001 Robare et al. ..... 701/208
6,285,949 B1 * 9/2001 Roediger ..... 701/117
6,473,688 B2 10/2002 Kohno et al.
6,489,920 B1 12/2002 Anders et al.

* cited by examiner

*Primary Examiner*—John Tweel
(74) *Attorney, Agent, or Firm*—Frank J. Kozak; Jon D. Shutter; Lawrence M. Kaplan

(57) ABSTRACT

A system and method are disclosed for collecting traffic information. One or more aircraft, such as helicopters, fly predetermined flight paths above a geographic area. The flight paths are determined so that portions of roads for which traffic information are to be collected are within the ranges of remote velocity sensors located on board the aircraft during the flights of these aircraft along their respective flight paths. Each aircraft includes positioning equipment that allows the precise position (i.e., altitude, latitude, and longitude) and attitude (i.e., roll, pitch, and yaw) of the aircraft during its flight to be determined. During a flight along the predetermined flight path, the remote velocity sensor in each aircraft is operated to perform scans of locations on roadways in the geographic area. Using a precise road map database and taking into account the location, velocity and attitude of the aircraft while each scan is being made, data indicating traffic conditions along the roadways are collected.

33 Claims, 5 Drawing Sheets

COMMUNICATIONS NETWORK 28 to and from AIRCRAFT 26 (FIG. 2)
BASE STATION 22
COMMUNICATIONS 92
COMPUTER PLATFORM 110
TRAFFIC DATA SYNTHESIS & REPORTING 100
MAP MATCHING
SYNTHESIS
PARAMETER CALCULATION
REPORTING
GEO DB 210
USERS
TRAFFIC REPORTS FLY FLIGHT PATH
160
DETERMINE AIRCRAFT POSITION
170
SCAN ROADWAYS
180
FILTER DATA
184
TRANSMIT DATA
190
steps performed in AIRCRAFT 26
GEO DB 70
RECEIVE DATA
200
MAP MATCH
220
SYNTHESIZE DATA
250
CALCULATE TRAFFIC PARAMETERS
270
FORM REPORTS
280
TRANSMIT REPORTS
290
steps performed at BASE STATION 22
GEO DB 210
150
USERS
TRAFFIC REPORTS

METHOD AND SYSTEM FOR COLLECTING TRAFFIC INFORMATION

BACKGROUND OF THE INVENTION

The present invention relates to collecting information about traffic along roads in a geographic area, and in particular, the present invention relates to an efficient way for collecting real-time traffic information.

Traffic information is used for various purposes. Commuters use traffic information to plan their commutes to work. Trucking companies use traffic information to plan routes that minimize delays. Delivery companies use traffic information to determine routes that are most efficient. Government agencies use traffic information for emergency response purposes, as well as to plan new highways and make other improvements.

There are different kinds of traffic information. Real-time traffic information indicates the actual conditions that exist on roadways at the present time. Historical traffic information indicates the long-term average traffic conditions that have existed on roadways over a period of time. There are also different types of traffic information that are collected. For example, one important type of traffic information relates to traffic incidents (e.g., accidents) that have relatively short-term but significant effects. Other important types of traffic information include traffic flow, traffic volume, transit times, throughput and average speed.

There are various ways to collect traffic information. One way to collect traffic information is to place sensors along roadways. Another way to collect traffic information is to observe traffic conditions from a tall building or aircraft (e.g., a traffic helicopter). Still another way to obtain traffic information is to have a number of vehicles travel along roads and report traffic information back to a traffic information center.

Although these existing ways to collect traffic information are satisfactory, there still exists room for improvements. Infrastructure-based methods are associated with relatively high deployment costs thereby limiting them to major roads. Vehicle-based methods are associated with communications and processing costs that have limited deployment of these methods as well. Accordingly, it would be beneficial to have a method that collects traffic information for a large number of roads efficiently and reliably.

SUMMARY OF THE INVENTION

To address these and other objectives, the present invention includes a system and method for collecting traffic information. One or more aircraft, such as helicopters, fly predetermined flight paths above a geographic area. These aircraft may be piloted or remotely controlled. The flight paths are determined so that portions of roads for which traffic information are to be collected are within the ranges of remote velocity sensors located on board the aircraft during the flights of these aircraft along their respective flight paths. Each aircraft includes positioning equipment that allows the precise position (i.e., altitude, latitude, and longitude) and attitude (i.e., roll, pitch, and yaw) of the aircraft during its flight to be determined. During a flight along the predetermined flight path, the remote velocity sensor in each aircraft is operated to perform scans of locations on roadways in the geographic area. Taking into account the location, velocity and attitude of the aircraft while each scan is being made, data indicating traffic conditions from the scanned output are matched to a precise road map database and the traffic flows on every scanned road are thereby collected.

DETAILED DESCRIPTION OF THE PRESENTLY PREFERRED EMBODIMENTS

I. Overview

Figure 1:
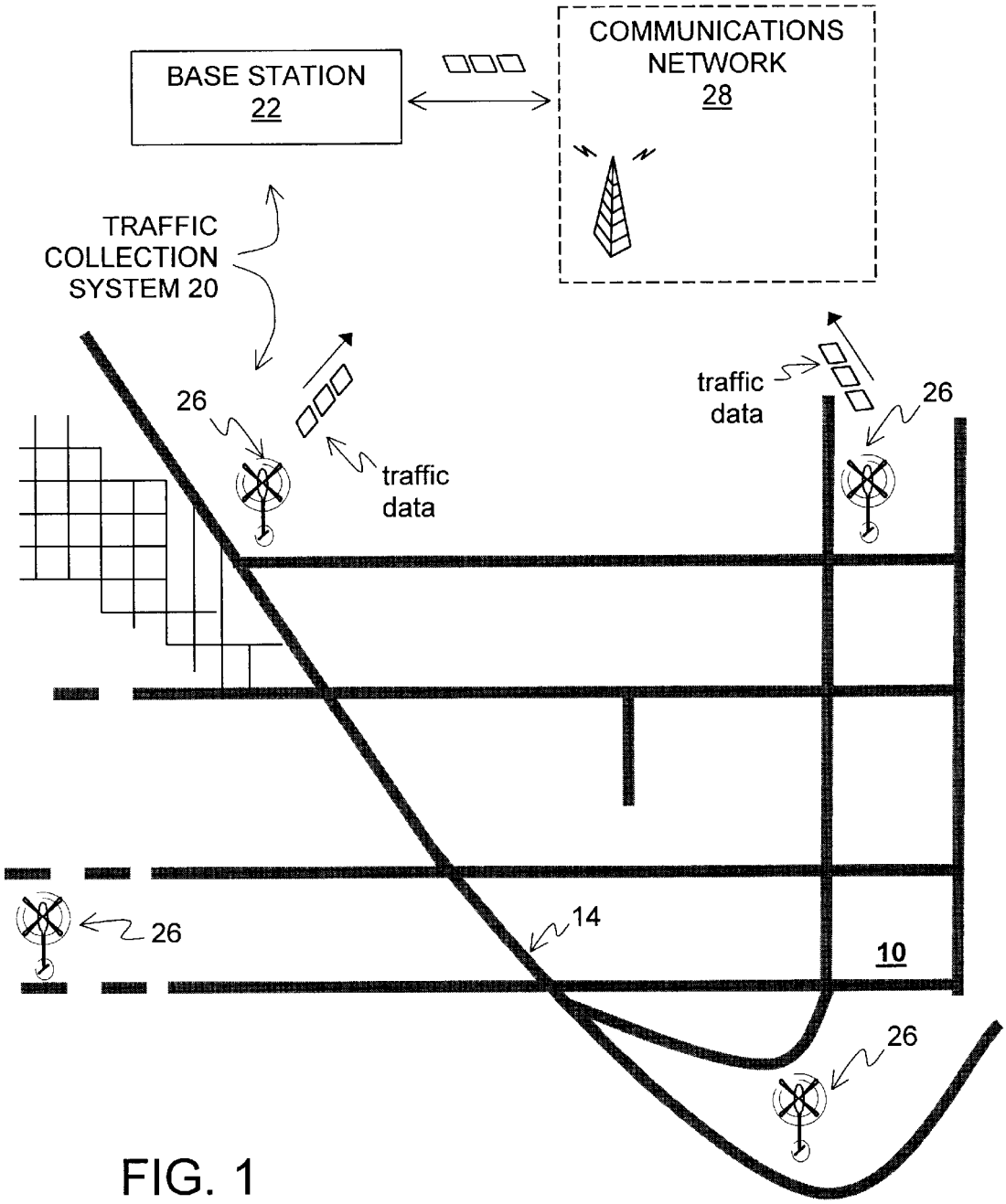
FIG. 1 is an illustration of a geographic area in which an embodiment of the present system is used to collect traffic information.

FIG. 1 shows a geographic area 10. The geographic area 10 corresponds to a metropolitan region or a portion thereof. Alternatively, the geographic area 10 may correspond to a region of a different size.

Located in the geographic area 10 is a road network 14. The road network 14 includes different functional classes of roads. For example, the road network 14 may include freeways, major highways, major business roads, minor business roads, residential streets, alleys, and rural roads.

A traffic collection system 20 collects information about traffic conditions on the road network 14. The traffic collection system 20 includes several components. According to one embodiment, the traffic collection system 20 includes a base station 22, traffic collection components located in one or more aircraft 26 and a communications network 28 that enables the traffic collection components located in the aircraft to communicate with the base station 22.

(In a preferred embodiment, the aircraft 26 are helicopters, although in alternative embodiments other types of aircraft may be used, including planes, gliders, drones, lighter-than-air craft, balloons, blimps, dirigibles, etc. Alternatively, a combination of different types of aircraft may be used.)

II. The Airborne Traffic Data Collector Components

Figure 2:
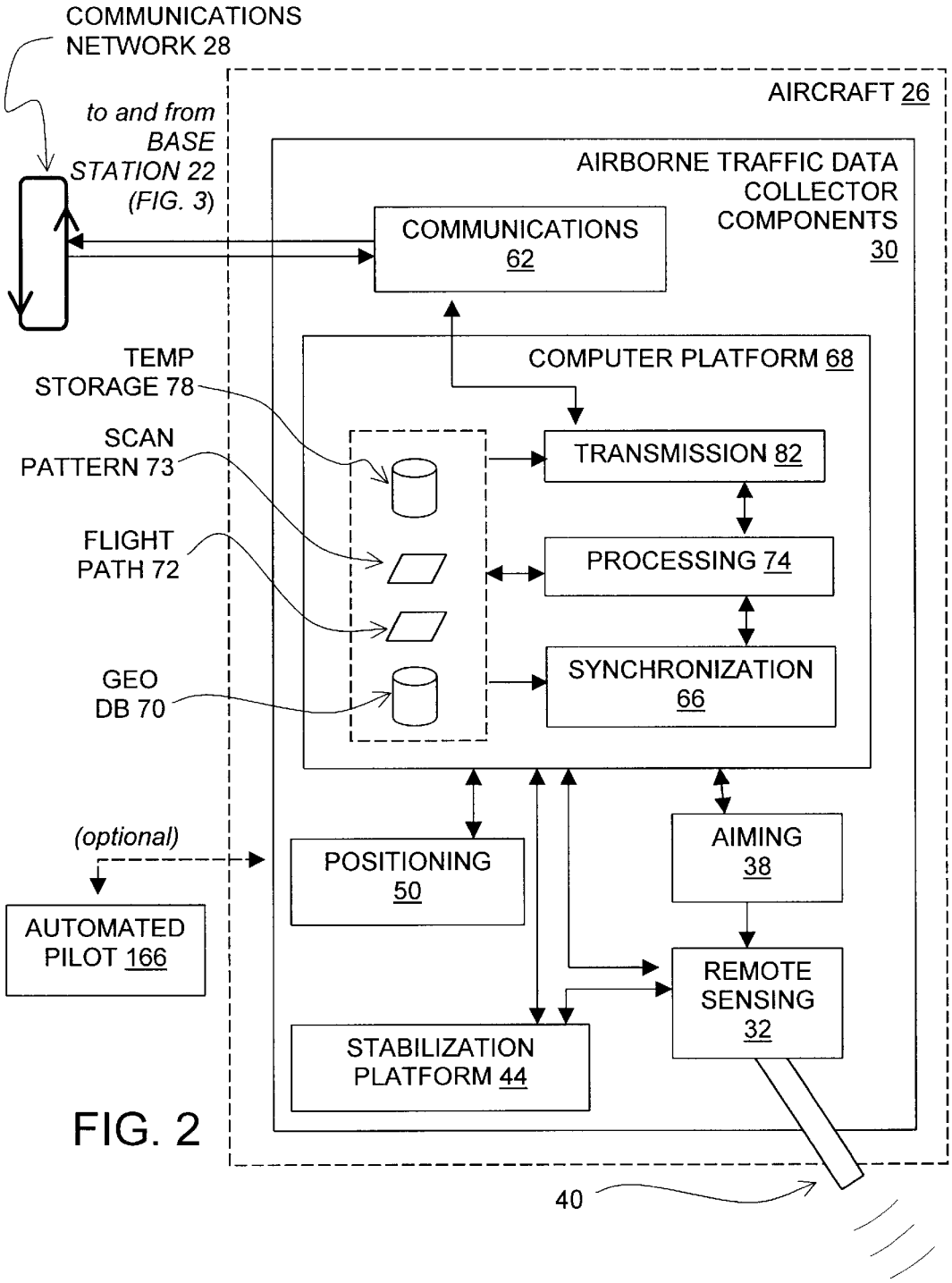
FIG. 2 is a block diagram of some of the components in one of the aircraft shown in FIG. 1.

Each of the aircraft 26 is equipped to collect traffic information. Referring to FIG. 2, each aircraft 26 includes airborne traffic data collector components 30. The airborne traffic data collector components 30 include a combination of hardware and software.

The airborne traffic data collector components 30 include a remote velocity sensing apparatus 32. The remote velocity sensing apparatus 32 is capable of determining the speed (i.e., velocity) of remotely-located moving objects. The remote velocity sensing apparatus 32 uses any suitable technology for this purpose, such as a pulse laser, microwave, lidar or Doppler radar, etc. The remote velocity sensing apparatus 32 determines the velocity of remotely-located objects by transmitting a beam (e.g., microwave, coherent light, etc.) at the remotely-located object and measuring a property of the reflected beam.

Coupled to the remote velocity sensing apparatus 32 is an aiming apparatus 38. The aiming apparatus 38 controls the remote velocity sensing apparatus 32 to direct the beam at various different locations along the road network 14 as the aircraft 26 travels through the geographic area 10. The aiming apparatus 38 operates under computer control so that the remote velocity sensing apparatus 32 can be precisely aimed at particular locations, preferably at specific times. In one embodiment, the aiming apparatus 38 is capable of directing the remote velocity sensing apparatus 32 through a 360 degree scan around the aircraft 26 and through an elevation of 90 degrees. The aiming apparatus 38 includes a telescopic lens 40 or other means for automatically or manually aiming the remote sensing beam at objects several kilometers away.

The remote velocity sensing apparatus 32 and the aiming apparatus 38 are mounted on a stabilization platform 44 in the aircraft 26. The stabilization platform 44 includes equipment that stabilizes the remote velocity sensing apparatus 32 and the aiming apparatus 38. The stabilization platform 44 uses inertial sensors, a gyroscope, etc., to negate the effects of the movements of the aircraft 26 so that the aiming apparatus 38 can aim the remote velocity sensing apparatus 32 at precisely predetermined locations and at precise times.

Located in the aircraft 26 is a positioning system 50. The positioning system 50 includes equipment that enables the precise position (e.g., latitude, longitude, and altitude) and attitude (e.g., roll, pitch, and yaw) of the aircraft 26 to be determined continuously while the aircraft 26 is flying. The positioning system 50 may include a GPS (or DGPS), an altimeter, inertial sensors, or a combination of these or of other types of equipment.

The airborne traffic data collector components 30 in each aircraft 26 include a communications system 62. The communications system 62 is used by the airborne traffic data collector components 30 to interface with the communications network 28 to send data to (and receive data from) the base station 22. The communications system 62 is preferably a relatively high bandwidth system capable of transmitting a relatively large amount of data to a ground station. Suitable communications systems include GSM or GPRS, although other systems can be used.

The airborne traffic data collector components 30 in each aircraft 26 also include a synchronization program 66. The synchronization program 66 is run on a suitable computer platform 68 located in the aircraft 26. The synchronization program 66 is coupled to and exchanges data with the remote velocity sensing apparatus 32, the aiming apparatus 38, the stabilization platform 44 and the positioning system 50.

In addition, the synchronization program 66 obtains data from an on-board geographic database 70. The on-board geographic database 70 includes information about some or all the roads that form the road network 14 in the geographic region 10. In particular, the on-board geographic database 70 includes information about the roads about which traffic flow information is to be collected along the flight path of the aircraft 26. The on-board geographic database 70 includes information that identifies the positions of each of the roads represented therein. For example, in one embodiment, the on-board geographic database 70 includes data that identify points (e.g., latitude, longitude, and altitude) along each of the represented roads. The on-board geographic database 70 may include other kinds of information. The on-board geographic database 70 may include data about all the roads along the flight path of the aircraft 26. Alternatively, the on-board geographic database 70 includes data about only some of the roads, such as the higher functional class roads, like freeways, major highways, and possibly major and minor business roads.

The synchronization program 66 also uses flight path data 72 and a scan pattern 73. The flight path data 72 indicate the path (i.e., series of positions) that the aircraft follows along its flight path. The scan pattern 73 indicates the direction(s) (i.e., azimuth, elevation) at which to aim the remote velocity sensing apparatus 32 for positions along the flight path. The synchronization program 66 uses the flight path data 72 and the scan pattern 73, in conjunction with data from the geographic database 70 and data from the positioning system 50 and the stabilization platform 44, to control the aiming apparatus 38 to aim the remote velocity sensing apparatus 32 at precise locations along the road network based on the relative positions of the aircraft 26 along its flight path.

Another program included among the airborne traffic data collector components 30 in each aircraft 26 is a processing program 74. The processing program 74 is run on the computer platform 68 located in the aircraft 26. Alternatively, the processing program 74 can be run on another computer platform. The processing program 74 interfaces with the synchronization program 66.

The processing program 74 performs the steps of extracting pertinent vehicle velocity data from the data received from the remote sensing apparatus, matching the vehicle velocity data to a precise digital map to identify the roads to which the data relate, and filtering the vehicle velocity data. The extracting step processes the data obtained by the remote velocity sensing apparatus 32 to separate the data that indicate vehicle velocities from extraneous data, such as data indicating stationary objects like buildings or parked vehicles. The extracted velocity data indicate discrete measurements of traffic flow at specific locations along roads at specific times. Then, the processing program 74 causes the road velocity data to be matched to a precise digital map to indicate the precise locations on the road network at which the remote velocity sensing apparatus was aimed. Then, the data are filtered. There are several ways that the data can be filtered. For example, a portion of a road may be scanned several times within the span of several seconds. The filtering function analyzes the data associated with these scans and, if they all indicate approximately the same vehicle velocity along the portion of road, redundant data readings are filtered out. According to another example, during the flight of an aircraft along its flight path, each road may be scanned at several different locations along its length. If adjacent portions along a road have similar vehicle velocity readings, a single velocity reading can be used for these adjacent road portions. An advantage of filtering is that the amount of data that need to be transmitted from the aircraft is reduced.

The processing program 74 also causes the road velocity data received from the remote velocity sensing apparatus to be associated with a time stamp. Optionally, the processing program 74 also causes the road velocity data received from the remote velocity sensing apparatus to be associated with reference-frame data. The reference-frame data indicate the velocity, position, orientation, etc., of the aircraft while the road velocity data are being measured. In addition, the processing program 74 causes the road velocity, time-stamp, and reference-frame data to be temporarily stored on the aircraft 26 before being transmitted to the base station 22. The computer platform 68 includes a suitable data storage device or memory 78 for this purpose.

Another program among the airborne traffic data collector components 30 in the aircraft 26 is a transmission program 82. The transmission program 82 is run on the computer platform 68 located in the aircraft 26 or alternatively, the transmission program 82 is run on another computer platform. The transmission program 82 interfaces with the processing program 74 and the communications system 62. The transmission program 82 sends the data collected by the processing program 74 to the base station 22 using the communications system 62. The transmission program 82 may send the data continuously or alternatively, the transmission program 82 may accumulate data and send the data in discrete portions. The transmission program 82 may implement suitable compression or compaction. The transmission program 82 may also provide for suitable retransmission, error-handling, etc.

The airborne traffic data collector components 30 may include other components in addition to those mentioned.

III. The Base Station

Figure 3:
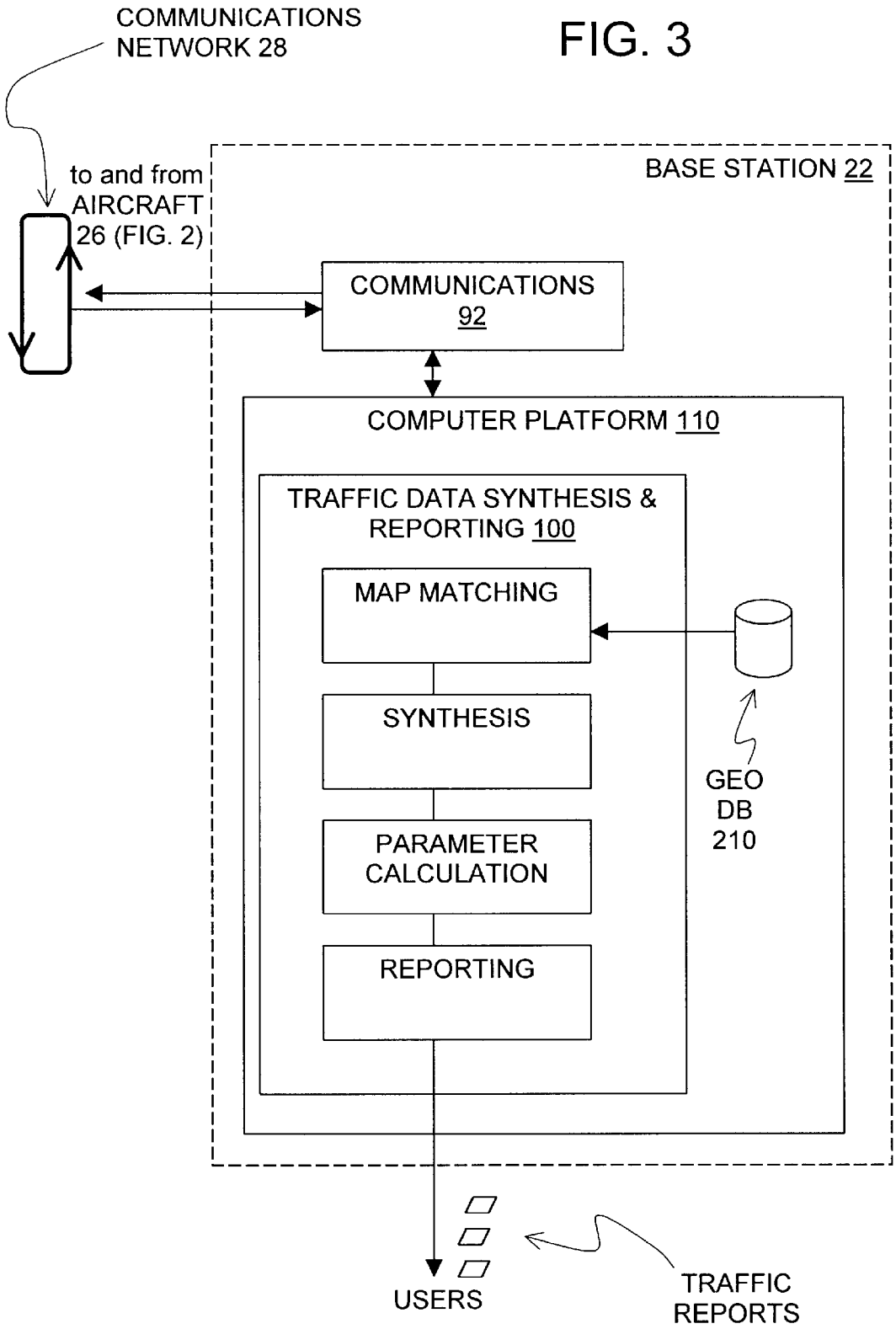
FIG. 3 is a block diagram of some of the components in the base station shown in FIG. 1.

As mentioned in connection with FIG. 1, the traffic collection system 20 includes a base station 22. The base station 22 is a collection of hardware and software components. FIG. 3 shows some of the components of the base station 22.

One of the components of the base station 22 is a communications system 92. The communications system 92 interfaces with the communications network 28 so that the base station 22 is capable of receiving data from and sending data to the airborne traffic data collection components 30 in each of the aircraft 26.

The base station 22 includes a traffic data synthesis and reporting program 100. The traffic data synthesis and reporting program 100 is run on a suitable computer platform 110 at the base station 22. The traffic data synthesis and reporting program 100 receives the data transmitted from the aircraft 26, uses the data transmitted from the aircraft 26 to determine traffic flow and other information, such as transit times, and reports traffic information to users. Operation of the traffic data synthesis and reporting program 100 is described in more detail below.

IV. Setup

Before the traffic flow collection system (20 in FIG. 1) can be used, flight paths for the aircraft 26 are determined. The flight paths for the aircraft 26 are determined so that portions of each road for which traffic information is to be collected are within range of the remote velocity sensing apparatus located in at least one of the aircraft at least once during the flight of the aircraft along its flight path. More specifically, each of the aircraft travels different flight paths. The different flight paths cover the entire geographic area so that the traffic along the road network across the entire area can be sensed by the equipment in at least one of the aircraft. The predetermined flight paths are selected so that significant portions of the roads for which traffic data are to be collected are in a direct line-of-sight of at least one of the aircraft during its flight along the predetermined flight path associated therewith.

Figure 4:
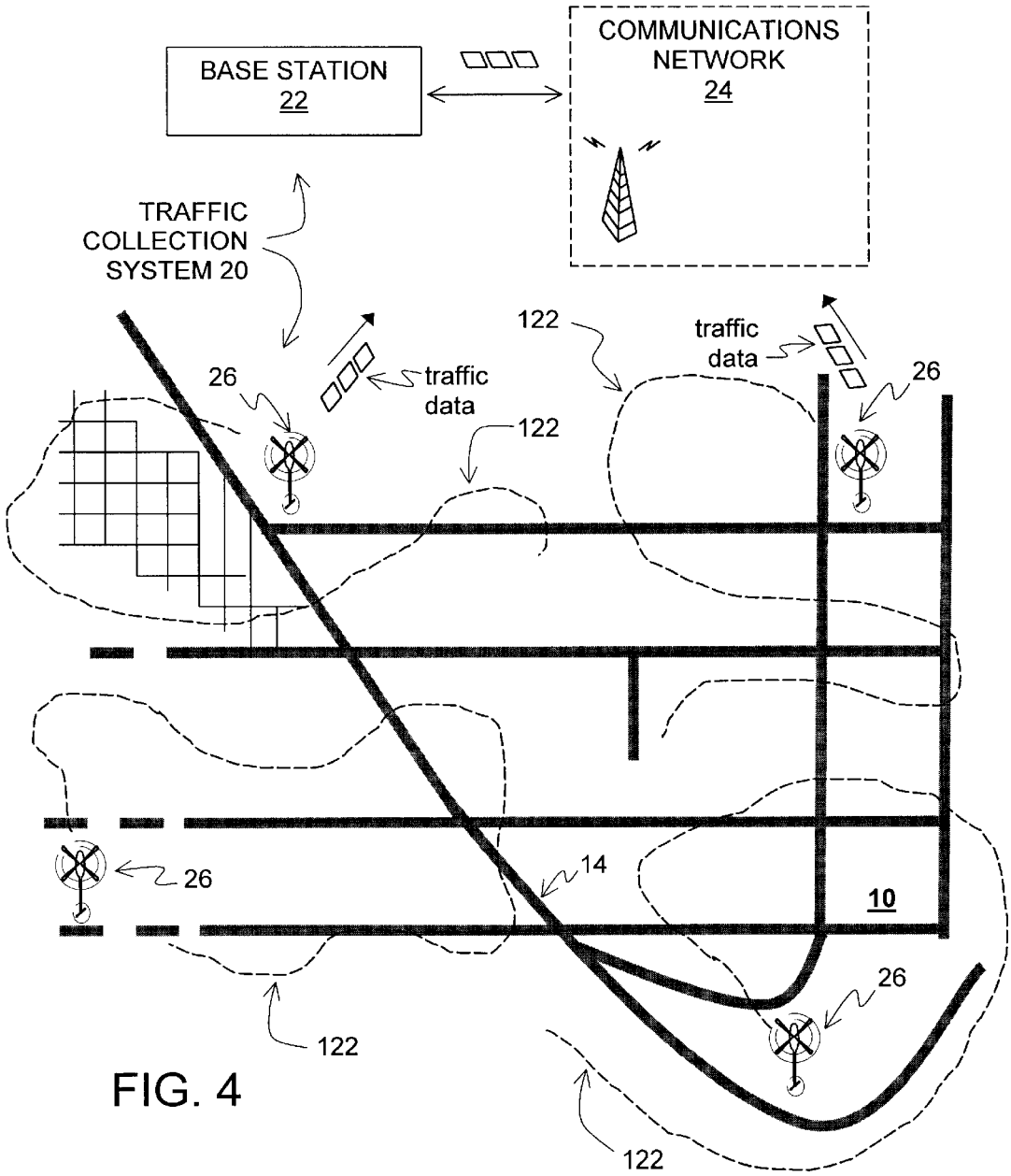
FIG. 4 shows the geographic area of FIG. 1 with flight paths for the aircraft.

FIG. 4 shows examples of a plurality of flight paths 122, each associated with a respective one of the plurality of aircraft 26.

The flight path for each aircraft 26 is determined based on several factors. Some of these factors include:

1) the number of available aircraft that can operate at one time;
2) the speed of the aircraft;
3) a path completion time;
4) the cyclic frequency for rescanning a given target location;
5) the miles of roads for which traffic information is to be collected;
6) the flying altitude of the aircraft above ground level;
7) the geographic terrain of the area;
8) the road network of the geographic area;
9) the type of aircraft (e.g., helicopter, airplane, drone); and
10) the size of the geographic area.

These various factors are used when developing flight paths. For example, if more aircraft are available, the entire geographic area can be covered more quickly (i.e., with shorter flight path completion times). According to another example, if the terrain of the geographic area is hilly, it may take more aircraft to cover a geographic region of a given size because the hills may restrict the line-of-sight for sensing of roads from the aircraft. There may be additional factors that affect the determination of flight paths.

Different geographic areas will require different flight paths. Furthermore, over time, the flight paths for a geographic area may be updated to take into account new roads or more detailed coverage of existing roads.

According to one embodiment, flight paths are determined as relatively wide swathes. This allows an aircraft following a flight path to acquire all the necessary lines-of-sight with the portions of roads for which data are being collected while making the flight path relatively easy to follow. The width of a flight path swath is determined taking into account various factors, such as the type of aircraft, the terrain, etc.

When a flight path is determined, scan patterns for the flight path can also be determined. As mentioned above, the scan pattern indicates the directions and frequencies to aim the remote velocity sensing apparatus for various positions along the flight path. In one embodiment, the remote velocity sensing apparatus may be operated with a full sweep scan pattern. With a full sweep scan pattern the remote sensing apparatus is aimed sequentially in a succession of parallel or otherwise regularly-offset paths to create a scan pattern that completely covers a polygonal area on the ground. When operated with a full sweep scan pattern, the processing program in the aircraft extracts the pertinent vehicle velocity data from a scan of the entire area. According to another embodiment, a targeted scan pattern can be determined. With a targeted scan pattern the remote sensing apparatus is aimed at only the portions of roads for which vehicle velocity data are being collected. According to the targeted scan pattern embodiment, the directions to aim the remote sensing apparatus are determined based on the lines-of-sight to various roads at the various positions along the flight path. With the targeted scan pattern embodiment, extracting the pertinent vehicle velocity data from the scans may be facilitated.

Once the flight paths and associated scan patterns are determined, data indicating each flight path and associated scan patterns are provided to the respective aircraft. An aircraft may receive more than one of the flight paths and associated scan patterns so that alternative flight paths may be flown.

V. Operation

Figure 5:
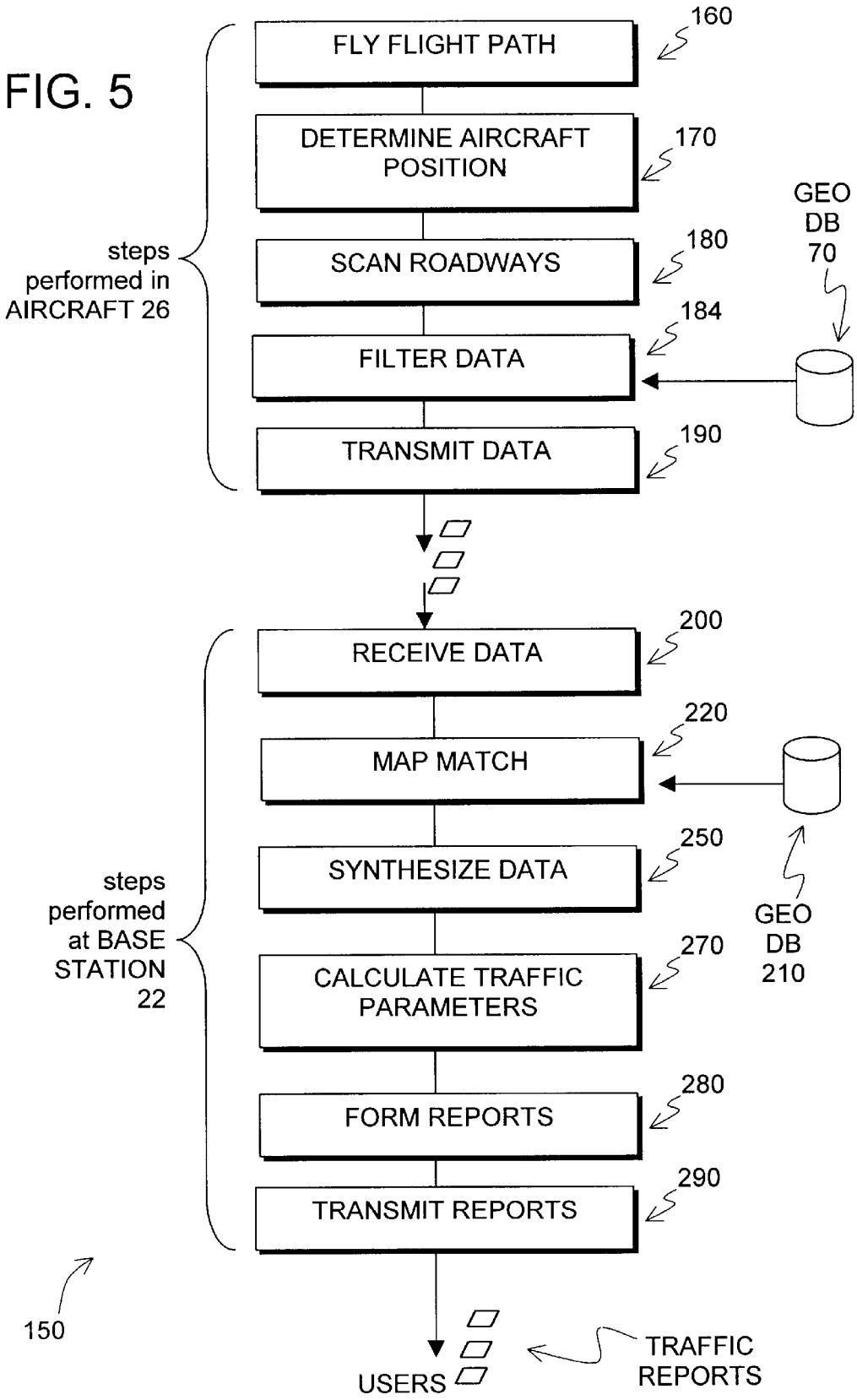
FIG. 5 is a flowchart showing steps in a process for collecting traffic information using the system of FIG. 1.

FIG. 5 shows parts of a process 150 for collecting traffic information. As mentioned above, each aircraft 26 used by the traffic information collection system 20 is associated with a predetermined flight path (e.g., 122 in FIG. 4). To collect traffic information, each of the aircraft 26 flies its predetermined flight path (Step 160 in FIG. 5). In one embodiment, the aircraft pilot operates the aircraft so that it follows its predetermined flight path. In an alternative embodiment, the aircraft is equipped with an automated pilot system (e.g., 166 in FIG. 2). According to this alternative embodiment, the predetermined flight path for an aircraft is provided to the automated pilot system 166 and the automated pilot system 166 operates the aircraft so that it follows its predetermined flight path.

Each of the aircraft may fly its predetermined flight path several times. Alternatively, an aircraft may fly its predetermined flight path only once. In another alternative, an aircraft may fly a succession of different flight paths.

As each aircraft travels its predetermined flight path, the position of the aircraft 26 is determined by the positioning system 50 located in the aircraft (Step 170 in FIG. 5). While following the flight path, the processing program and the synchronization program (74 and 66 in FIG. 2) cause the aiming apparatus 38 and the remote velocity sensing apparatus 32 to sense vehicle velocities along roads along the flight path in accordance with the scan pattern 73 taking into account the aircraft position and attitude (Step 180). The data may be filtered to remove the unwanted or unnecessary data readings (Step 184). The on-board database 70 may be used for this purpose. The data indicating the sensed vehicle velocities are sent to the base station (Step 190). Optionally, reference-frame data indicating the speed, location, and orientation of the aircraft are also sent. (As mentioned above, the data may be temporarily stored on the aircraft. The data may be stored for several seconds or several minutes.)

At the base station 22, the traffic data synthesis and reporting program 100 receives the data transmitted from each of the aircraft 26 (Step 200). Using a geographic database 210 located at the base station, the data received from each aircraft are matched to specific roads located in the geographic area 10 (Step 220). The geographic database 210 includes information about some or all the roads that form the road network (14 in FIG. 1) in the geographic area 10, including information about the higher functional class roads, such as freeways and major highways, and possibly about major and minor business roads, residential roads, etc.

The geographic database 210 includes information that identifies the positions of each of the roads represented therein. For example, in one embodiment, the geographic database 210 includes data that identify points (e.g., latitude, longitude, and altitude) along each of the represented roads. The geographic database 210 also includes data that identify the name and/or highway designation of each of the represented roads. The geographic database 210 may include data that indicate the number of lanes along each road, the widths of each road, the locations and widths of lane dividers and medians, the locations of ramps, intersections, bridges, tunnels, overpasses, etc. The geographic database 210 also includes information about the legal posted speed limit (or speed range category) at each point (or selected points) along the represented roads. The geographic database 210 may include other kinds of information.

As mentioned above, the data collected by each aircraft indicate discrete measurements of traffic flow at specific points along roads as measured remotely from the aircraft during its flight along its flight path. The map matching process matches the data received from the various aircraft to specific roads represented by the geographic database and to specific locations along the roads. The map matching process may be configured to match data for only certain roads in the geographic area or for only certain categories of roads.

After the data are matched to appropriate roads, the data for each road are synthesized (Step 250). The step organizes the discrete data measurements for each road being monitored. Each road may be scanned several times at several different locations along its length during a flight by an aircraft along its flight path. In some cases, a road may be visible to more than one aircraft flying along their flight paths, and if so, portions of the road may be scanned by more than one aircraft. This step also takes into account scans of roads from prior flights.

After the data for each road are synthesized, various traffic parameters are calculated (Step 270). For example, transit times can be calculated. As mentioned above, the processing program (74 in FIG. 2) in each aircraft also collects reference-frame data that indicate the velocity, orientation, and position of the aircraft while the road velocity data are being collected. Using the road velocity data and the reference-frame data, transit times can be calculated along each road. The transit time indicates the amount of time it takes for a vehicle to transit a particular portion of a road. In addition, other traffic information may be calculated, such as the average speed, speed variance, flow variance, traffic flow, etc.

After the various traffic parameters are calculated, traffic reports are prepared (Step 280). These traffic reports can be organized into various different formats. The traffic reports can be sent directly to end users, e.g., vehicle drivers (Step 290). Alternatively, the traffic reports can be sent to other entities that use or combine the data in various ways. Some of these entities may redistribute the traffic data directly or indirectly to end users.

It is noted that the disclosed method for the remote collection of vehicle velocity data may sometimes be affected by adverse weather conditions. However, the disclosed method does not require direct visual contact with the roads being monitored and the method can be used under various conditions. The collection of vehicle velocity data with the disclosed method can be performed through cloud cover, as well as at night.

VI. Alternatives

In the above description, various functions were described as being performed at either the base station or on the aircraft. Some of the functions that were described as being performed at the base station can be performed on the aircraft, and vice versa. For example, the map matching process can be performed either at the base station or on the aircraft.

The base station (100 in FIG. 1) that collects and processes the traffic data received from the aircraft that fly over a geographic area may be located in the same geographic area as the aircraft. Alternatively, the base station may be located in another geographic area. If the base station is located in another geographic area, the data collected from the aircraft flying over one geographic area are transmitted to the geographic area where the base station is located. The data may be transmitted over any suitable communications system, including a combination of wireless and land-based communications networks. One base station may collect and process the data from aircraft located in multiple different geographic areas.

In connection with the above embodiments, it was indicated that when scans of the roadways are being performed from the aircraft, the scan pattern and the aircraft position were used to aim the remote sensor at the appropriate locations along the roadways. In addition, the geographic database used in the aircraft may include data about special distinguishing landmarks to assist in identifying the roads for which traffic measurements are to be obtained. For example, the geographic database may include data indicating the locations of tall or prominent buildings, towers, or other features, located along the flight path. These features may be easily detectable by appropriate aiming of the remote sensor apparatus in the aircraft. Sensing these easily detectable landmarks can help in determining the location and orientation of the aircraft relative to the other features represented in the geographic database (specifically, the roads). The detection of distinguishing landmarks, can be used in conjunction with other equipment in the aircraft, such as the positioning system, etc.

As mentioned above, the remote sensing apparatus may be operated using a full sweep pattern (in which the entire area around the aircraft is sensed and the pertinent vehicle velocity data are extracted) or a targeted pattern (in which the remote sensing apparatus is aimed precisely at specific locations along roads). If the remote sensing apparatus is operated in a fully targeted pattern, the need for additional map matching (i.e., post data acquisition) may be reduced or eliminated because the map matching step is essentially being performed before the data are acquired. The remote sensing apparatus may also be operated in a mode that combines a full sweep pattern and a targeted pattern.

In some embodiments, the aircraft used to collect the vehicle velocity data are piloted. In alternative embodiments, the aircraft may be unmanned or piloted from the ground.

In another embodiment, the scanning of locations along roads is performed by an aircraft that maintains a motionless or relatively motionless position over the geographic area. According to this embodiment, the aircraft is of a type that has the ability to remain relatively motionless over a single location. For example, a lighter-than-air airship may be suitable. According to this embodiment, the aircraft assumes an altitude that is high enough so that locations along the roads in the entire geographic area can be sensed from a single position. In this embodiment, the flight path is essentially a single position. As in the other embodiments, the remote sensing apparatus in the aircraft is aimed at the locations along roads for which traffic information is sought and the traffic flow is measured using an accurate digital map of the geographic area. In a further version of this embodiment, a plurality of aircraft may be used, each of which assumes a different motionless position over the geographic area. In another alternative, one aircraft may move between a series of successive different motionless positions over the geographic area at which remote sensing of locations along roads is performed. In yet another embodiment, a combination of one or more motionless positions and one or more moving position are used. As in the other embodiments, an accurate determination of the actual position of the aircraft is used to adjust the data obtained by scanning to compensate for any deviation of the actual aircraft position from a desired position at which the scans should be made.

It is intended that the foregoing detailed description be regarded as illustrative rather than limiting and that it is understood that the following claims including all equivalents are intended to define the scope of the invention.

I claim:

1. A method of collecting data that indicate traffic conditions on roads in a geographic area comprising the steps of:

having an aircraft fly a flight path over the geographic area;

while said aircraft is flying over the geographic area, scanning locations along roads with a remote velocity sensing apparatus in said aircraft to obtain data indicative of traffic conditions at said locations;

using a map database to identify the roads that correspond to the locations scanned with the remote velocity sensing apparatus; and associating the data indicative of traffic conditions at said locations with corresponding identities of said roads.

2. The method of claim 1 further comprising:

filtering data acquired by scanning to remove unwanted data readings.

3. The method of claim 2 wherein the filtering is performed in the aircraft.

4. The method of claim 2 wherein the filtering is performed in a base station to which the data acquired by scanning are sent.

5. The method of claim 1 further comprising:

determining transit times along the roads using the data indicative of traffic conditions associated with said roads.

6. The method of claim 1 wherein said aircraft flies along said flight path a plurality of successive times and further wherein said locations are scanned during each of said plurality of successive times to obtain data indicative of traffic conditions at successive times.

7. The method of claim 1 wherein the aircraft is a helicopter.

8. The method of claim 1 wherein the aircraft is a lighter-than-air aircraft.

9. The method of claim 1 further comprising:

determining the position of the aircraft while said aircraft is flying over the geographic area.

10. The method of claim 1 wherein a plurality of aircraft are used to obtain data indicative of traffic conditions throughout the geographic area, wherein each of said plurality of aircraft flies a separate different flight path over the geographic area.

11. The method of claim 1 wherein the flight path is predetermined.

12. The method of claim 1 further comprising:

using a detailed map database in the aircraft to precisely aim the remote sensing apparatus at the locations being scanned.

13. The method of claim 1 using a predetermined scan pattern to precisely aim the remote sensing apparatus at the locations being scanned.

14. The method of claim 1 further comprising:

transmitting the data indicative of traffic conditions at said locations from said aircraft to a base station where the map database is used to identify the roads that correspond to the locations scanned with the remote velocity sensing apparatus.

15. The method of claim 14 wherein the base station receives data indicative of traffic conditions from a plurality of aircraft each of which flies a separate different flight path over the geographic area and each of which scans locations along roads along its respective separate flight path with a separate remote velocity sensing apparatus located therein to obtain data indicative of traffic conditions at said scanned locations.

16. The method of claim 1 wherein a relatively wide area is scanned including the locations along the roads for which data indicative of traffic conditions are sought as well as areas outside the locations along the roads for which data indicative of traffic conditions are sought, and wherein the method further comprises:

extracting from data obtained by scanning over the relatively wide area the data that pertain to the locations along the roads for which data indicative of traffic conditions are sought.

17. The method of claim 1 wherein the scanning is targeted at the locations along the roads for which data indicative of traffic conditions are sought to reduce scanning of areas other than the locations along the roads for which data indicative of traffic conditions are sought.

18. The method of claim 1 wherein said locations are in a direct line-of-sight of said aircraft when said aircraft flies along the flight path.

19. The method of claim 1 further comprising:

providing traffic information to drivers, wherein the traffic information corresponds to the locations scanned with the remote velocity sensing apparatus.

20. The method of claim 1 wherein said flight path comprises a substantially stationary position.

21. The method of claim 1 further comprising:

compensating for movement of said aircraft relative to said flight path when aiming the remote velocity sensor at the locations along the roads for which data indicative of traffic conditions are sought.

22. The method of claim 1 wherein said aircraft is unpiloted.

23. A system for collecting information about traffic conditions on roads in a geographic area comprising:

an aircraft having airborne traffic data collector components comprising:

a positioning system that determines a position of the aircraft while the aircraft is flying;

a remote velocity sensing apparatus;

a stabilization platform coupled to said remote velocity sensing apparatus;

an aiming apparatus that includes a real-motion compensating system, wherein said aiming apparatus is coupled to said remote velocity sensing apparatus and responsive to said positioning system and wherein said aiming apparatus uses said real-motion compensating system to aim said remote velocity sensing apparatus at specific locations in the geographic area as the aircraft is flying along a flight path; and an airborne communications system that transmits data indicative of traffic conditions sensed by said remote velocity sensing apparatus at said specific locations; and a base station comprising:

a land-based communications system that receives the data indicative of traffic conditions sensed by the remote velocity sensing apparatus in said aircraft;

a geographic database containing data that represent roads in said geographic area including data that indicate locations of said roads; and a data synthesis program that uses said geographic database to associate the data indicative of traffic conditions received from said aircraft with said roads.

24. The system of claim 23 wherein said base station receives data indicative of traffic conditions sensed by each of a plurality of aircraft each of which includes a separate set of airborne traffic data collector components and wherein said data synthesis program uses said geographic database to associate the data indicative of traffic conditions received from each of said plurality of aircraft with said roads.

25. The system of claim 24 wherein each of said plurality of aircraft fly different flight paths.

26. The system of claim 23 wherein said flight path is predetermined.

27. The system of claim 23 wherein said aircraft is a helicopter.

28. The system of claim 23 wherein said aircraft is a lighter-than-air aircraft.

29. The system of claim 23 wherein the remote velocity sensing apparatus in said aircraft is a laser-based device.

30. The system of claim 23 wherein the remote velocity sensing apparatus in said aircraft is a radar-based device.

31. The system of claim 23 wherein the remote velocity sensing apparatus in said aircraft is a lidar-based device.

32. The system of claim 23 wherein said aircraft has an airborne geographic database used by said aiming apparatus to determine said specific locations at which to aim said remote velocity sensing apparatus.

33. The system of claim 23 wherein said aircraft has data that indicate a predetermined flight path along which said aircraft flies while sensing traffic conditions.

* * * * *